US007500293B2

(12) United States Patent
Noelle

(10) Patent No.: US 7,500,293 B2
(45) Date of Patent: Mar. 10, 2009

(54) DRUM FOR A PRODUCTION UNIT FOR A NON-WOVEN MATERIAL, METHOD FOR PRODUCTION OF A NON-WOVEN MATERIAL AND NON-WOVEN MATERIAL OBTAINED THUS

(75) Inventor: Frederic Noelle, Montbonnot (FR)

(73) Assignee: Rieter Perfojet, Montbonnot (FR)

( * ) Notice: Subject to any disclaimer, the term of this patent is extended or adjusted under 35 U.S.C. 154(b) by 0 days.

(21) Appl. No.: 11/945,622

(22) Filed: Nov. 27, 2007

(65) Prior Publication Data

US 2008/0066274 A1 Mar. 20, 2008

Related U.S. Application Data

(62) Division of application No. 10/510,382, filed as application No. PCT/FR03/01101 on Apr. 8, 2003, now Pat. No. 7,350,279.

(30) Foreign Application Priority Data

Apr. 12, 2002 (FR) ..... 02 04604

(51) Int. Cl.
*D04H 1/46* (2006.01)

(52) U.S. Cl. ..... 28/104

(58) Field of Classification Search ..... 28/104, 28/105, 106, 167, 103; 68/903, 201, 205 R, 68/204; 264/211.13, 211.14, 211.15, 211.18; 162/368, 369, 297, 310, 348, 363, 204, 208, 162/217

See application file for complete search history.

(56) References Cited

U.S. PATENT DOCUMENTS 2,218,817 A 10/1940 Frost
3,700,404 A 10/1972 Janisch et al.
3,781,957 A 1/1974 Luthi
3,837,046 A 9/1974 Kalwaites
4,228,123 A * 10/1980 Marshall ..... 28/105
4,868,958 A 9/1989 Suzuki et al.
4,879,170 A 11/1989 Radwanski
5,009,747 A 4/1991 Viazmensky et al.
5,301,401 A * 4/1994 Suzuki et al. ..... 28/167
5,727,292 A 3/1998 Vuillaume
5,761,778 A * 6/1998 Fleissner ..... 28/104
5,768,756 A 6/1998 Noelle
5,960,525 A * 10/1999 Fleissner ..... 28/104
6,055,710 A 5/2000 Fleissner
6,321,425 B1 11/2001 Putnam et al.
6,324,738 B1 12/2001 Fleissner
6,865,784 B2 3/2005 Noelle
6,910,571 B1 6/2005 Ertel
6,957,474 B2 10/2005 Fleissner
2001/0005926 A1 * 7/2001 Noelle ..... 28/104
2002/0116801 A1 8/2002 Oathout et al.

(Continued)

*Primary Examiner*—Amy B Vanatta
(74) *Attorney, Agent, or Firm*—Pearne & Gordon LLP

(57) ABSTRACT

A drum for processing nonwovens has a perforated lateral surface and an interior divided into first and second compartments, respectively associated with first and second lateral surface portions of the drum. A partial vacuum in each of the compartments aspirates and secures a tangentially-engaged nonwoven preform against the lateral surface of the drum for further processing. The drum may be incorporated in a production unit or installation including a spunbond tower for spinning filaments to form the nonwoven preform for tangential delivery to the drum. The resulting nonwoven may thereby be provided with uniform properties.

12 Claims, 6 Drawing Sheets

U.S. PATENT DOCUMENTS

2002/0168910 A1* 11/2002 Vuillaume et al. ..... 442/381
2003/0021970 A1* 1/2003 Noelle ..... 28/104
2003/0101556 A1* 6/2003 Fleissner ..... 28/104
2003/0106195 A1* 6/2003 Fleissner ..... 28/104
2003/0217448 A1* 11/2003 Andersen ..... 28/104

* cited by examiner

DRUM FOR A PRODUCTION UNIT FOR A NON-WOVEN MATERIAL, METHOD FOR PRODUCTION OF A NON-WOVEN MATERIAL AND NON-WOVEN MATERIAL OBTAINED THUS

This application is a division of U.S. application Ser. No. 10/510,382, filed Oct. 5, 2004, which is a 371 of International Application PCT/FR03/01101, filed Apr. 8, 2003.

BACKGROUND OF THE INVENTION AND RELATED ART

The present invention relates to nonwoven materials and their methods and units of production.

U.S. Pat. No. 6,321,425 describes a method of fabricating a nonwoven material which consists in sending a material, originating from a spunbond tower which normally comprises successively from top to bottom a generator of a curtain of filaments, in particular plastic filaments, a slotted attenuator device for drawing the filaments of the curtain, a diffuser and a conveyor for receiving the filaments, to a calendar which consolidates the formed material preform, then to a water jet tangling drum. This method has the disadvantage of adversely affecting the uniformity of the formation of the material and of orienting the filaments preferentially in the machine direction by the drawing which is applied thereto.

SUMMARY OF THE INVENTION

The invention remedies this disadvantage by making it possible to obtain a nonwoven material whose properties are substantially isotropic, that is to say substantially identical whether it be in the machine direction or in the cross direction.

This is achieved with a drum comprising a fixed cylindrical body with perforated lateral surface surrounded by a holed sleeve driven in rotation relative to the axis of the cylindrical body, and means intended to create a partial vacuum inside the body. According to the invention, a water-impermeable partition subdivides the interior of the body into two compartments delimited by the partition and respectively by a first and a second portion of the lateral surface and both placed under partial vacuum by the means intended to create same.

The first compartment of the drum according to the invention is used to bring onto the drum a material preform that lies on an associated conveyor, substantially tangential to the drum at a so-called contact point (this is the point at which the conveyor and the drum are closest to one another without actually touching), even if this material preform is still slightly consolidated, as is the case when it is a material coming from a spunbond tower, without previously needing to calender the material preform or other operations subject it to involving a drawing operation which definitively damage the isotropy of the properties of the nonwoven material finally obtained.

Preferably, the first compartment begins opposite the point of contact of the conveyor tangential to the drum and ends opposite a point of the lateral surface downstream, in the direction of rotation of the sleeve, of the point of contact. As soon as the material preform has thus been applied to the drum by the partial vacuum existing in the first compartment, it is subject to the water jet tangling.

According to one embodiment, the first compartment extends over a cylindrical sector of the body defined, in the transverse sectional view of the cylindrical body, substantially by two radii perpendicular to one another, the first compartment thus substantially occupying a quarter of the interior of the body. Preferably, the cylindrical sector occupied by the first compartment is disposed in the second quadrant between 3 and 6 o'clock.

The means intended to create a partial vacuum may be common to the two compartments but, according to a preferred embodiment, each compartment has its own means of creating a partial vacuum and, preferably, the partial vacuum is more intense in the first compartment than in the second. In particular, a partial vacuum lying between 30 and 400 mbar can in particular be created in the first compartment and a partial vacuum lying between 30 and 300 mbar in the second compartment.

So that the drum can properly take hold of the material preform, it is best that the ratio of the total area of the perforations, per unit of surface, to the area of the lateral surface on which they lie is greater for the first compartment than for the second. This ratio may be between 5% and 30% for the first compartment whereas it is between 2% and 15% for the second compartment.

The perforations of the lateral surface opposite the second compartment are in particular slots which lie opposite pressurized water injectors on the portion of the sleeve that passes just opposite the portion of the lateral surface of the second compartment. The pressure of the jets is usually between 30 and 400 bar and the diameter of each jet between 75 and 200 microns. A rigid rotating perforated roll is mounted on the exterior of the fixed cylindrical body and its interior diameter is adjusted to the exterior diameter of the cylindrical body so that the minimum clearance thus preserved allows rotation while minimizing air leaks. According to the technical solution used for the fabrication of this rotating roll, it is envisaged that plastic battens mounted on springs are used to improve the separation seal of the two compartments. This rotating roll may be a simple perforated metal sheet, a roll made of bronze or of stainless steel pierced with holes helically disposed, a honeycomb roll. This may be a tube made of rolled perforated sheet metal covered by a drainage sleeve made of coarse metal material which provides a good uniformity of water extraction. This rotating roll supports a thinner perforated sleeve which effectively supports the filaments and the fibers of the nonwoven during the hydraulic tangling. The holes in the sleeve may be randomly distributed. The holes may also be arranged in lines or in staggered fashion. The sleeve holes may also be distributed in small areas of arranged perforations distributed randomly on the surface of the sleeve. The sleeve may consist of a metal material or of a synthetic material or of a mixture of metal material and synthetic material. Preferably the diameter of the sleeve holes should be between 50 and 500 microns. To obtain patterns on the material, provision can also be made to slip an open-work sheath over the sleeve, the openings of which having at least one dimension greater than 2 mm.

A further object of the invention is a unit for production of a nonwoven material comprising a spunbond tower with conveyor leading to a drum according to the invention. Preferably, the tower conveyor and the conveyor tangential to the drum are one and the same conveyor, but it is also possible to provide two distinct conveyors.

According to a particularly preferred embodiment, the drum is mounted directly downstream of the tower. In this specification, directly downstream means without the interposition of a device provoking the drawing of the material. There is therefore no calendar, but there may be a compactor cylinder.

A further object of the invention is a method for production of a nonwoven material, which consists in using a unit according to the invention and in adjusting the speed of the tower conveyor or of the tangential conveyor to a value greater than the linear speed of the drum (calculated on the circumference of the drum). This produces a nonwoven material whose ratio of the tensile strength in the machine direction to that in the cross direction may be less than 1 due to this difference in speed. When the speeds are substantially the same, a ratio of less than 1.2 and of particularly approximately 1 of the tensile strength in the machine direction to that in the cross direction of the nonwoven material according to the invention can be obtained such that the nonwoven material according to the invention is particularly well isotropic.

BRIEF DESCRIPTION OF THE DRAWINGS

In the appended drawings, given as an example.

DETAILED DESCRIPTION OF THE DRAWINGS

Figure 1:
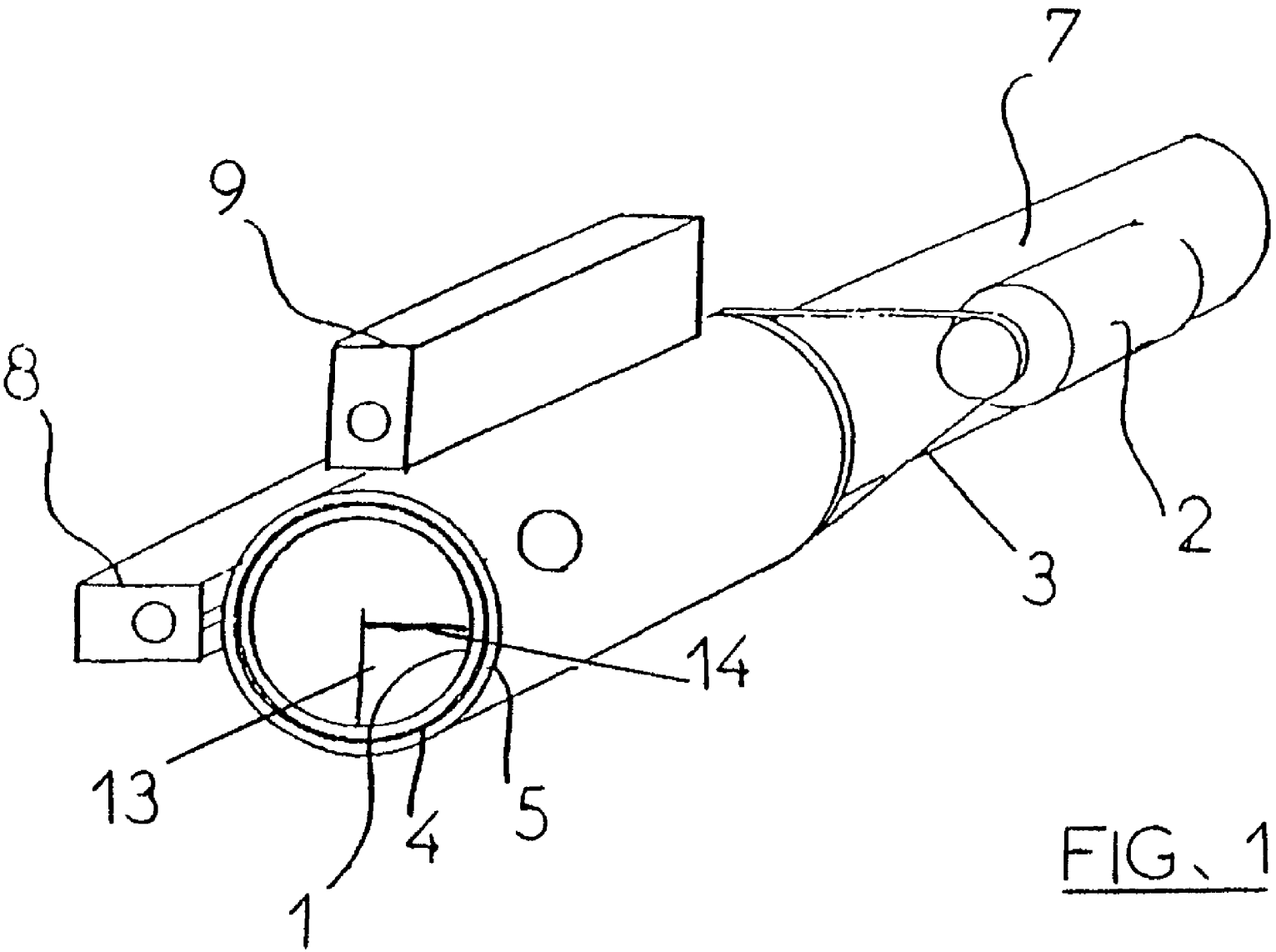
FIG. 1 is a perspective view, with parts broken away, of a unit according to the invention.

The drum represented schematically in FIG. 1 comprises an internal body 1 consisting of a fixed roll with a diameter of 400 mm and of a metal sheet forming the lateral surface. The lateral surface is perforated with perforations of a diameter of 8 mm in one portion which will delimit what will later be called the first compartment and the lateral surface is pierced with several slots particularly opposite the injectors in a portion which will delimit what will later be called the second compartment. The ratio (void fraction) of the sum of the areas of the perforations to the total lateral surface area is between 5% and 30% in the first compartment and between 2% and 15% in the second compartment. A perforated rotating roll 4 is slipped over the body 1 and is driven in rotation by a belt drive device 2. The roll 4 is holed. The ratio of the sum of the areas of the holes to the total lateral surface area of the roll 4 is between 30% and 90% and preferably between 40% and 80%. The roll 4 has a thickness of between 1.5 and 30 mm and is usually made of stainless steel or of bronze. A sleeve 5 is slipped over the rotating roll 4. The ratio of the sum of the areas of the holes to the total lateral surface area of the sleeve 5 is between 5% and 20% and preferably between 5% and 15%. The sleeve 5 is obtained by nickel electroplating. It is microperforated with holes of a diameter from 5 to 500 microns and preferably between 200 and 400 microns. It has a thickness of between 0.1 and 0.6 mm and preferably between 0.2 and 0.4 mm. The inside of the drum 1 communicates with a duct 7 for extracting the air and the water. Two injectors 8 and 9 respectively send jets of water toward the sleeve 5 along generatrixes of the body 1.

Figure 2:
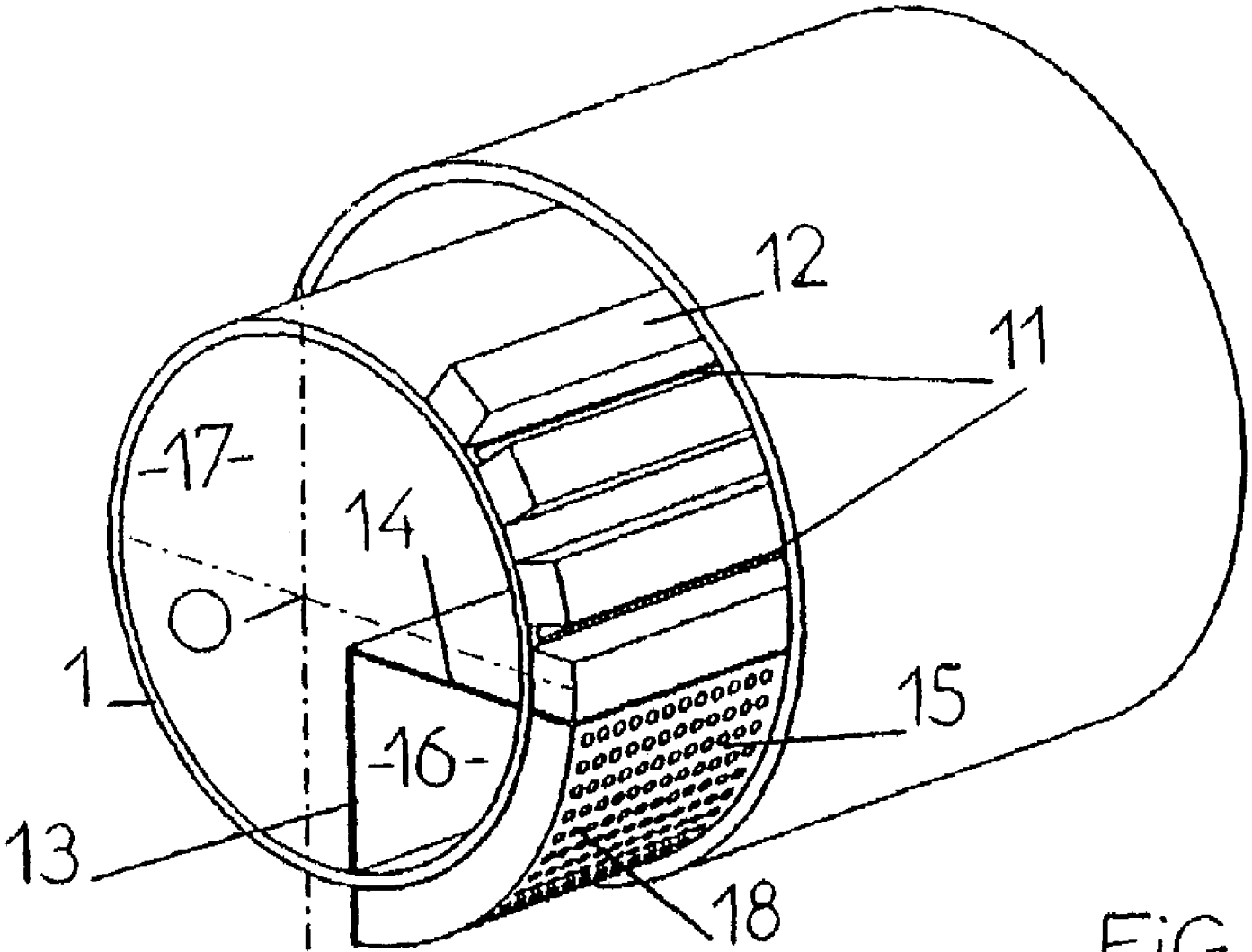
FIG. 2 is a perspective view of a drum, with parts broken away, in accordance with the invention.

FIG. 2 is a view in perspective better illustrating an embodiment of the drum. It consists of an inner roll 1 with axis O which is slotted as is the metal sheet forming the lateral surface along two slots 11 disposed between braces 12 and lying in the quadrant between 1 o'clock and 3 o'clock. In the quadrant from 3 o'clock to 6 o'clock a partition is arranged consisting of two metal sheets 13, 14 together forming a roll sector. The two metal sheets 13, 14 extend along a view in transverse section perpendicular to the axis O substantially along two radii. They are water-impermeable. They delimit between them with the portion 15 of the lateral surface lying between 3 o'clock and 6 o'clock a first compartment 16 while the partition 13, 14 delimits with the rest of the body 1 a second compartment 17 into which the slots 11 open. Rows of holes 18 made on the portion 15 of the lateral surface open into the first compartment 16. The first compartment 16 is connected to means used to place it under partial vacuum. They are of the same type as the duct 7, but are distinct from it. The void fraction of the portion 15 is 16%. It is greater than that corresponding to the slots 11. In one variant, the first compartment also comprises a slot (not shown), placed at 6 o'clock opposite the point of tangency of the conveyor transporting the preform of nonwoven with the roll. The purpose of this slot is to facilitate the transfer of the filament material onto the portion of the roll facing the first compartment.

Figure 3:
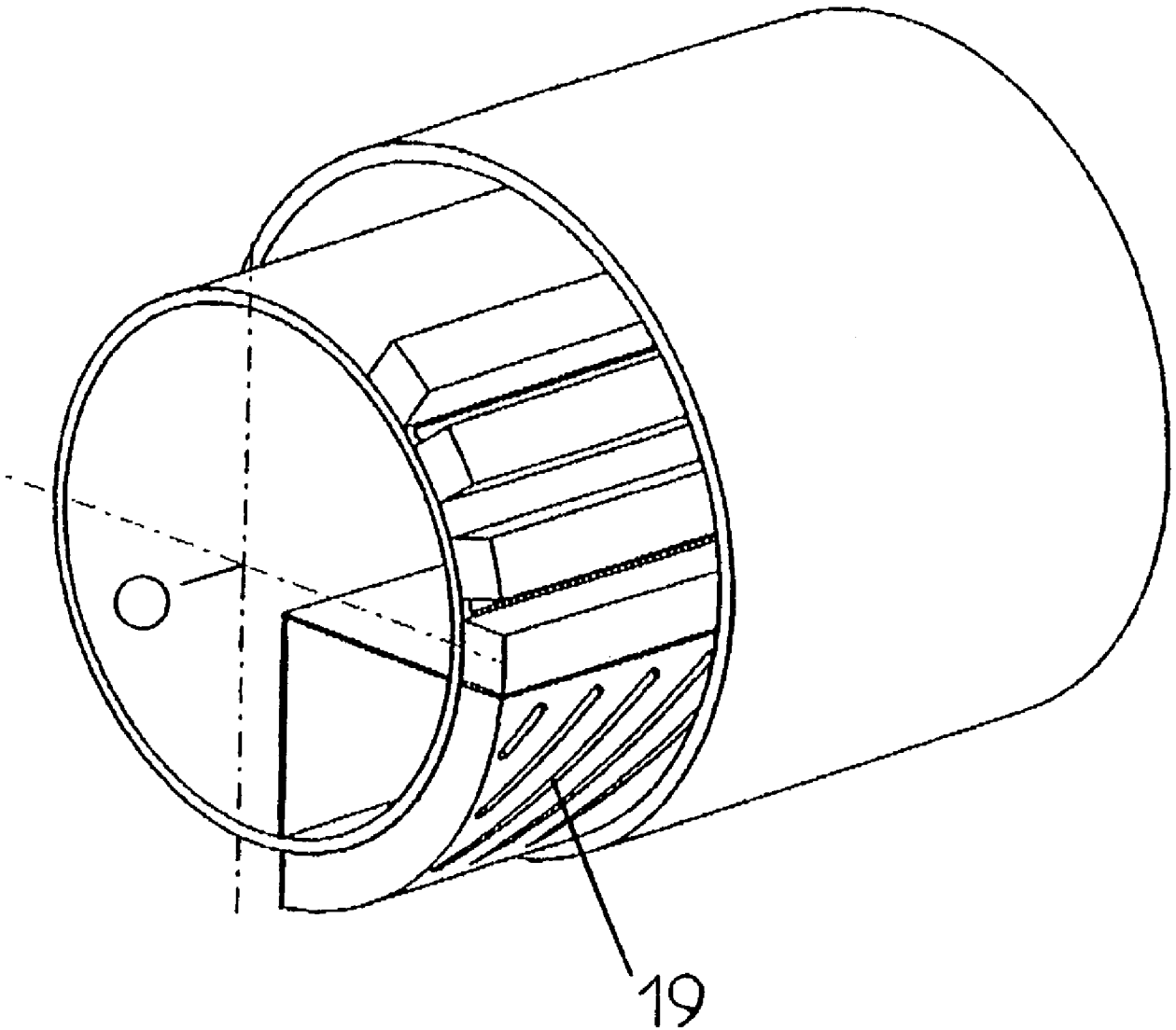
FIG. 3 is a perspective view, similar to FIG. 2, of a modified drum in accordance with the invention.

The embodiment represented in FIG. 3 is identical to that in FIG. 2, except that the rows of holes 18 of the portion 15 are replaced by slots 19 which are not parallel with the axis O.

Figure 4:
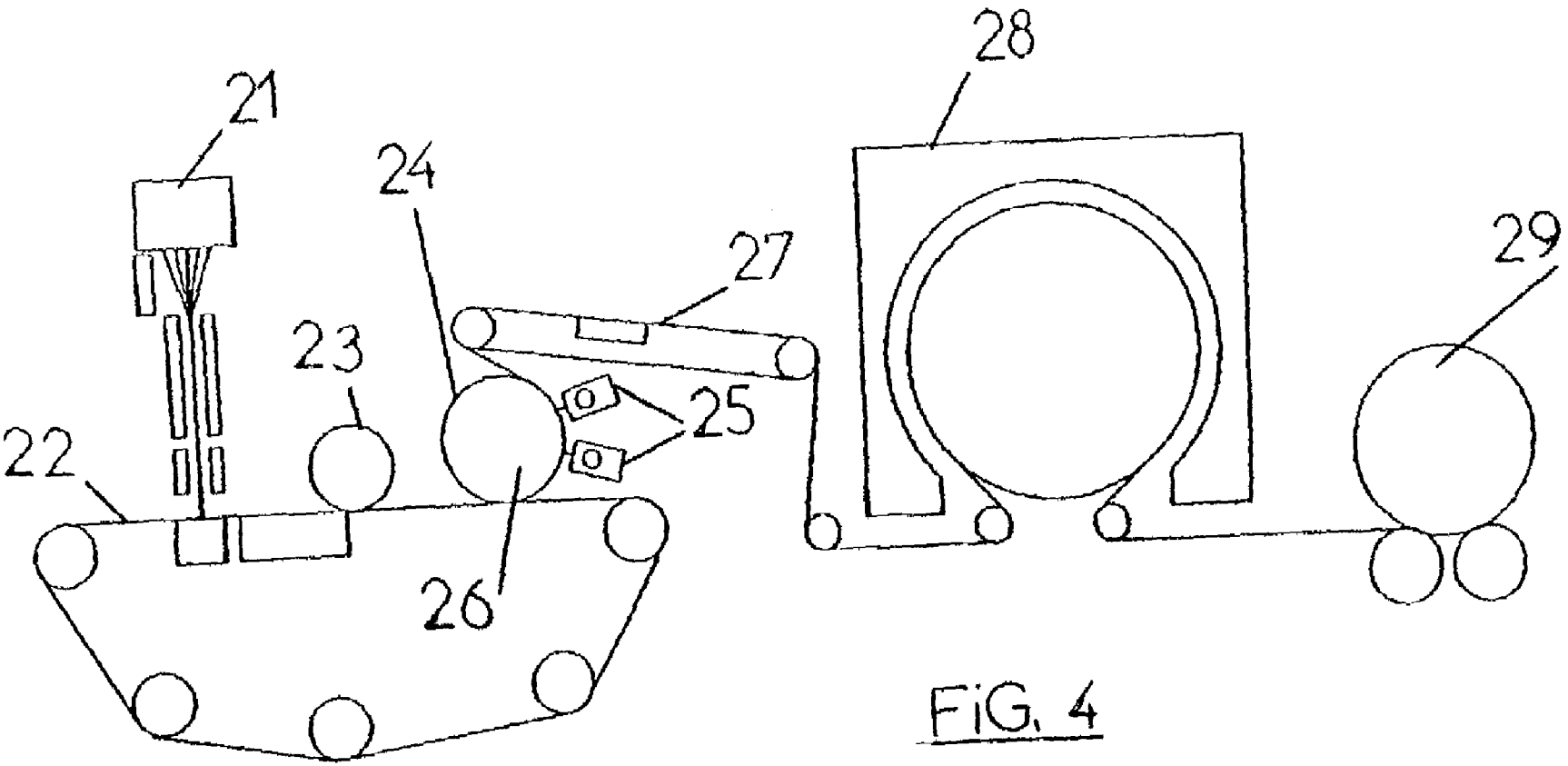
FIG. 4 is a schematic view of a production unit or installation in accordance with the invention.

The unit represented in FIG. 4 comprises a spunbond tower 21 with conveyor 22 leading, with where necessary the interposition of a presser roll 23, to a drum 24 according to the invention. The conveyor 22 is tangential to the drum 24 at the lowest point of the latter. Two water injectors 25 are provided opposite the portion of the lateral surface of the second compartment. One of the water injectors 25 is disposed angularly in a manner immediately adjacent to the first compartment 26, which means that one of the radial walls defining the second compartment 26 lies in a position substantially corresponding to 4 o'clock while the first injector 25 lies in a position slightly before 4 o'clock. The preform of nonwoven material that is deposited on the conveyor 22 is aspirated onto the drum 24 thanks to the aspiration supplied by the first compartment 26, is tangled hydraulically by the injectors 25 and leaves the drum 24 to pass onto an inclined conveyor 27 before entering an oven 28 and then leaving it to be rolled on a roller 29.

Figure 5:
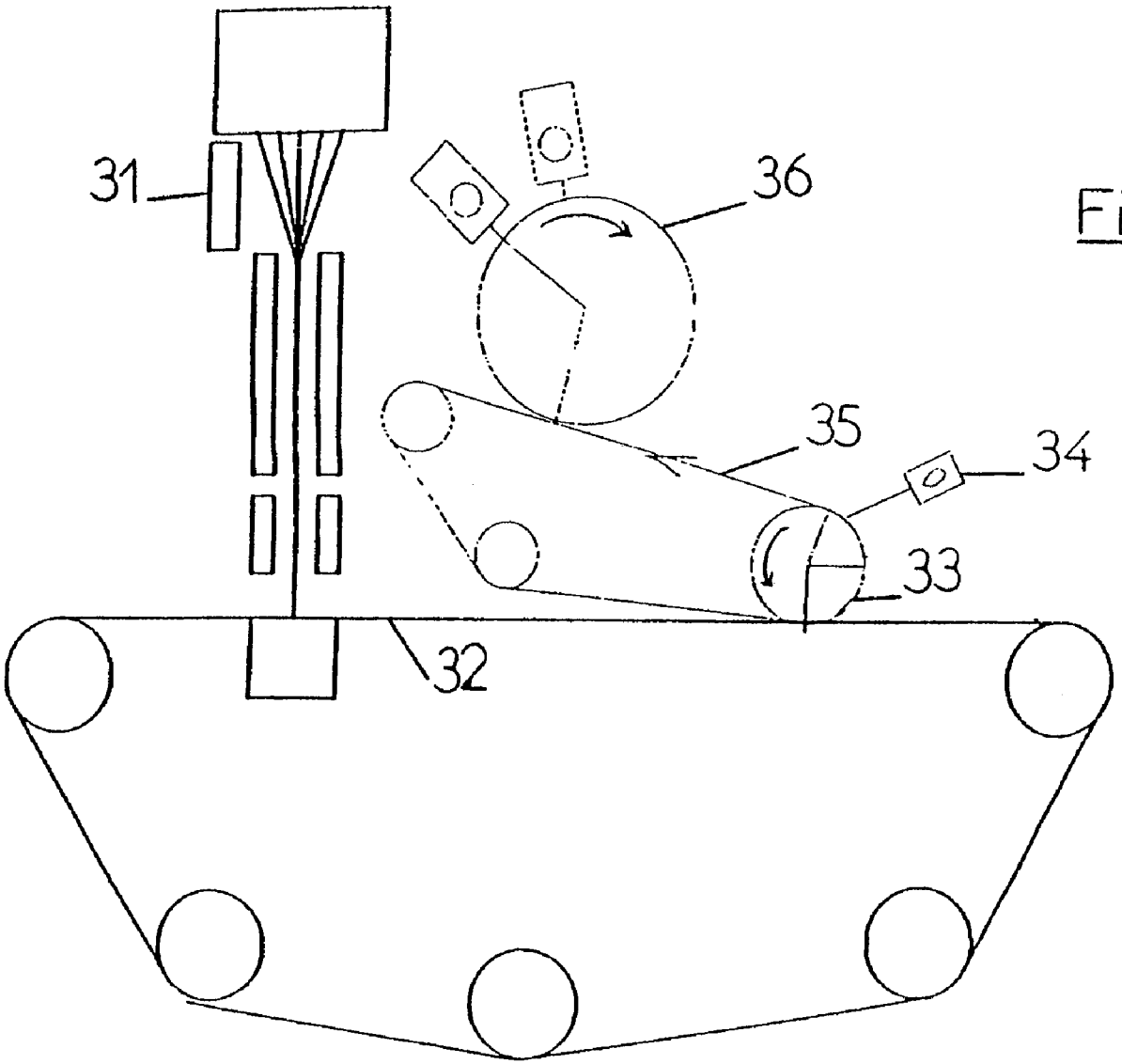
FIG. 5 is a schematic view of a modified production unit or installation in accordance with the invention.

FIG. 5 again shows a spunbond tower 31 which deposits a preform of nonwoven material 32, which is taken hold of by a first drum 33 according to the invention having an injector 34 and which is sent by a conveyor 35 to a second drum 36 according to the invention.

Figure 6:
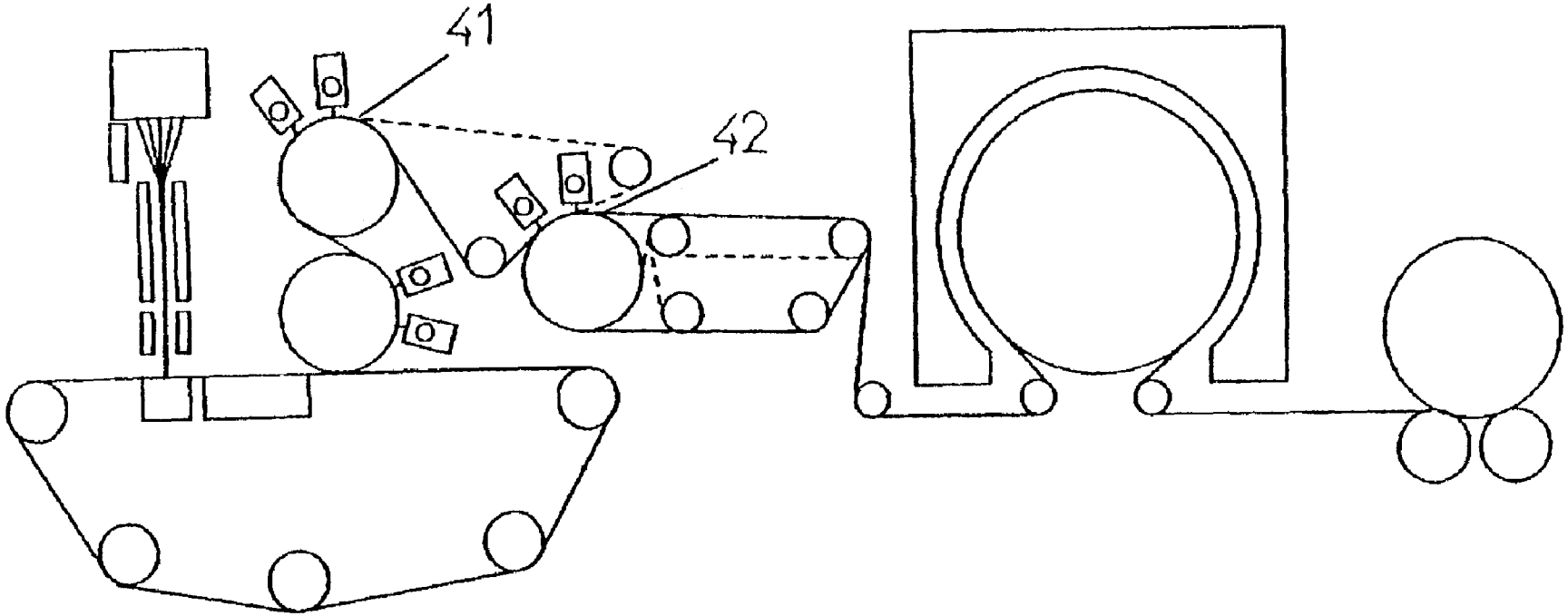
FIG. 6 is a schematic view of another modified production unit or installation in accordance with the invention.

FIG. 6 shows a variant of FIG. 4 in which the filament material is transferred to additional drums 41 and 42 to apply further consolidation and patterns to it before it enters the oven for drying by traversing air.

What is claimed is:

1. An apparatus for producing a nonwoven material comprising a first conveyor for conveying a preform of nonwoven material, an aspiration device for transferring said preform solely by aspiration from said first conveyor to a second conveyor, said second conveyor conveying said preform for transfer to a hydroentangling drum at a contact point location in which said second conveyor and said hydroentangling drum are tangentially disposed at a minimum spacing without intersecting or conforming profiles extending in the direction of preform travel, and water jets arranged to hydroentangle said preform only on said hydroentangling drum by impinging water on said preform free of conveyor interference.

2. The apparatus of claim 1, wherein the drum is above the second conveyor and the first conveyor is under the second conveyor.

3. The apparatus of claim 2, wherein the first and second conveyors respectively have projected dimensions in a horizontal plane, and the second conveyor projected dimension is shorter than the first conveyor horizontal projection.

4. The apparatus of claim 1, wherein the aspiration device is located inside the second conveyor.

5. The apparatus of claim 1, wherein a second aspiration device is arranged inside the drum.

6. The apparatus of claim 1, wherein the drum has an injector.

7. The apparatus of claim 1, wherein a spunbond tower deposits the preform on the first conveyor.

8. The apparatus of claim 1, further including a second aspiration device for transferring said preform to said hydroentangling drum solely by aspiration, whereby transfer of said preform between said conveyors is solely by aspiration device and said preform is free of compression between intersecting or conforming conveyors and drums.

9. A method for producing a nonwoven material comprising depositing a preform on a first conveyor, conveying the preform on the first conveyor to a second conveyor, transferring said preform solely by aspiration from said first conveyor to said second conveyor, conveying said preform on said second conveyor to a contact point location in which said second conveyor and a hydroentangling drum are tangentially disposed at a minimum spacing without intersecting or conforming profiles extending in the direction of preform travel, and hydroentangling said preform only on said hydroentangling drum by impinging water on said preform free of conveyor interference.

10. The method of claim 9, wherein the speeds of displacement of the preform on the first conveyor and the speed of displacement of the hydroentangled preform on the drum are the same.

11. The method of claim 9, wherein the speed of displacement of the preform on the first conveyor is higher than the speed of displacement of the hydroentangled preform on the drum.

12. The method of claim 9, including the further steps of transferring said preform solely by aspiration from said second conveyor to said hydroentangling drum, whereby said transfer of said preform between said conveyors is solely by aspiration and said preform is free of compression between intersecting or conforming conveyors and drums.

* * * * *